US005919117A

United States Patent [19]

Thompson et al.

[11] Patent Number: 5,919,117

[45] Date of Patent: Jul. 6, 1999

[54] CLIMBING TRAINING APPARATUS

[75] Inventors: James F. Thompson, Bountiful; David O. Meyers, Woodscross, both of Utah

[73] Assignee: Ascent Products, Inc., Bozeman, Mont.

[21] Appl. No.: 08/790,495

[22] Filed: Jan. 29, 1997

Related U.S. Application Data

[60] Provisional application No. 60/010,731, Jan. 29, 1996.

[51] Int. Cl.[6] ..... A63B 7/00; B65G 17/06

[52] U.S. Cl. ..... 482/37; 198/850

[58] Field of Search ..... 482/37, 51, 52, 482/54, 148; 198/850

[56] References Cited

U.S. PATENT DOCUMENTS

| | | | |
|---|---|---|---|
| 4,848,737 | 7/1989 | Ehrenfield . | |
| 4,927,136 | 5/1990 | Leask . | |
| 4,958,830 | 9/1990 | Huggins et al. . | |
| 5,040,785 | 8/1991 | Charnitski . | |
| 5,112,043 | 5/1992 | Gilfillian, Jr. . | |
| 5,125,877 | 6/1992 | Brewer . | |
| 5,145,475 | 9/1992 | Cares | 482/52 |
| 5,149,084 | 9/1992 | Dalebout et al. . | |
| 5,328,422 | 7/1994 | Nichols . | |
| 5,549,195 | 8/1996 | Aulagner et al. | 482/37 |

FOREIGN PATENT DOCUMENTS

| | | | |
|---|---|---|---|
| 2006887 | 9/1971 | Germany . | |
| 3502 127 A1 | 7/1986 | Germany . | |
| 0646998 | 2/1979 | U.S.S.R. | 482/37 |
| 646998 | 2/1979 | U.S.S.R. . | |
| 1556693 | 4/1990 | U.S.S.R. . | |
| 1600803 | 10/1990 | U.S.S.R. . | |

OTHER PUBLICATIONS

Treco Products, Inc., POWER CLIMB The Ultimate Cardiovascular Training System The Superior Cardiovascular Training System Sales Information Bulletin No. 3 and 4.

Brewer's Ledge, Inc. TREADWALL Total Body Fitness CLimbing Promotional Materials.

*Primary Examiner*—Stephen R. Crow

*Attorney, Agent, or Firm*—W. Norman Roth

[57] ABSTRACT

A climbing trainer comprising a movable climbing training wall surface defined by a continuous belt rotatably disposed about a pivotable frame and controllably actuated to rotate at a selected speed, the pivotable frame being rotatably supported by a support frame and the relative rotational position of the pivotable frame and support being selectable to provide a desired inclination of the climbing training wall within a range including positive inclinations and negative inclinations from a maximum negative inclination were said wall is disposed horizontally facing downward to a minimum negative inclination where said wall is disposed vertically, the trainer also comprising a control panel accessible to a user from the climbing training wall and at least one emergency stop switch coupled to an accessible actuatable pad.

20 Claims, 9 Drawing Sheets

CLIMBING TRAINING APPARATUS

RELATED APPLICATIONS

This Non-Provisional Application is based on applicants' prior Provisional application Ser. No. 60/010,731 filed Jan. 29, 1996. It is intended that the materials filed in the prior provisional application be incorporated herein by reference.

BACKGROUND OF THE INVENTION

1. Field of the Invention

The present invention relates generally to climbing training equipment. The invention relates more particularly to a climbing wall training apparatus of the type having a continuous rotating wall surface adapted for climbing.

2. Description of the Related Art

In providing training opportunities for climbers it has been recognized that man-made climbing surfaces located in convenient locations are advantageous. Accordingly many stationary climbing wall surfaces have been constructed throughout the world so as to be accessible to climbers. In order to provide satisfactory training, relatively high stationary climbing walls are usually required. These involve a very large structure, and if enclosed and isolated from the weather, a further large structure is required for this isolation purpose as well. These later considerations limit the places where climbing walls of this type can be located.

Provision of a continuous rotating wall surface allows the climbing training wall to be greatly reduced in height, and in effect can provide a simulation of ascending any height desired by sufficient rotation of the continuous wall surface. Moreover, such a reduction in size allows climbing training in existing buildings of conventional design without extensive modification. Moreover, greatly reduced cost characterizes such training apparatus when compared with necessarily large stationary walls. Safety is enhanced as the climber does not ascend to a great height and belay or other provisions to prevent falls of dangerous extent need not be required. Usually only a simple safety mat to cushion such short falls as may be experienced need be provided.

Difficulties in providing such a continuous rotating climbing surface for training have been encountered. Particularly, known devices do not provide a great deal of adjustability in positive and/or negative inclination. Some training walls have characteristics making training less effective, for example undesired play or give in the climbing surface due to deflections of components of the device under stresses applied during use.

These difficulties having been recognized, the present invention is directed to providing, at a reasonably low cost, a climbing training apparatus with improved operational characteristics.

SUMMARY OF THE INVENTION

The present invention accordingly provides a climbing trainer comprising:

a support frame;

a pivoting frame having first and second ends and a pivot axis intermediate the first and second ends, the pivoting frame being pivotably supported by the support frame allowing relative rotational movement about the pivot axis between the pivoting frame and the support frame;

means for selectively allowing and preventing relative rotational movement between the support frame and the pivoting frame about the pivot axis;

a movable climbing training wall surface comprising a continuous belt having an outer surface adapted to incorporate climbing holds, said continuous belt being carried by and rotatable about said pivoting frame, the continuous belt being restrained from movement transverse to a plane of the climbing training wall surface so as to resist forces tending to pull climbing holds incorporated in the outer surface of the continuous belt away from the wall surface and those tending to push said holds towards the wall surface, the climbing training wall surface being moveable in a direction parallel to a plane defined by the training wall surface by rotation of the continuous belt about said pivoting frame; and an actuator adapted to rotate said continuous belt about the pivoting frame, whereby the climbing training wall surface is moved to provide a simulated climb, the inclination of the climbing training wall surface being adjustable by rotation of the pivotable frame over a range of inclinations including negative inclinations.

In a more detailed aspect, the climbing trainer further comprises first and second spindles rotatably carried by the pivot frame at the first and second ends respectively of said pivot frame and rotatable about two parallel axes, the continuous belt comprising said climbing training surface being disposed about said spindles and bending about said two parallel axes, and wherein the continuous belt is stiffened to resist bending about a further axis orthogonal to said two parallel axes about which the first and second spindles rotate. In a further detailed aspect the continuous belt further comprises a multiplicity of rotatably interlinked panels, each being rotatable with respect to another about an axis parallel to said two parallel axes about which said first and second spindles rotate, and configured to mitigate unintentional engagement of the training wall surface with things which would otherwise be caught and moved with said wall surface by minimizing opening and closing of voids between said rotationally interlinked panels. The climbing trainer can further comprise at least one interchangeable hold releasably affixed to one of said rotationally interlinked panels.

In another detailed aspect the actuator can comprise a variable speed motor coupled to at least one of said first and second spindles, said climbing trainer further comprising a speed control operable from said continuous climbing surface, said speed control being adapted to vary the speed of the motor. Moreover, the climbing trainer can include an emergency safety kill switch operable from said continuous climbing training surface and adapted to stop movement of said belt about said pivoting frame and can also stop relative rotational movement between said pivoting frame and said base frame.

In a still further more detailed aspect the rotatably interlinked panels can be extrusions having first and second sides comprising an inner hinge portion having an outer cylindrical configuration at the first side and an outer hinge portion at the second side having an inner cylindrical configuration configured to engage said inner hinge portion of an adjacent panel and cooperate to provide a hinge between adjacent panels. The rotatably interlinked panels can be formed of a metal or metal alloy comprising aluminum.

In another more detailed aspect the continuous belt defines an inner surface and first and second ends, said belt being slidably connected to said pivoting frame by at least one connection between said pivoting frame and said inner surface intermediate the first and second ends of the belt, and wherein said connection allows relative movement of the frame and continuous belt in a direction parallel to a plane defined by the climbing training wall surface and restricts movement in a direction orthogonal to said plane, whereby said continuous belt is restricted from movement orthogonal to said plane defined by the climbing wall surface by at least one sliding connection to the pivoting frame intermediate the first and second edges of the belt.

Further aspects and advantages of the invention will be appreciated by study of the drawings and the following detailed description of the preferred embodiments which are provided by way of explanation and not by way of limitation.

DESCRIPTION OF THE PREFERRED EMBODIMENTS

Figure 1:
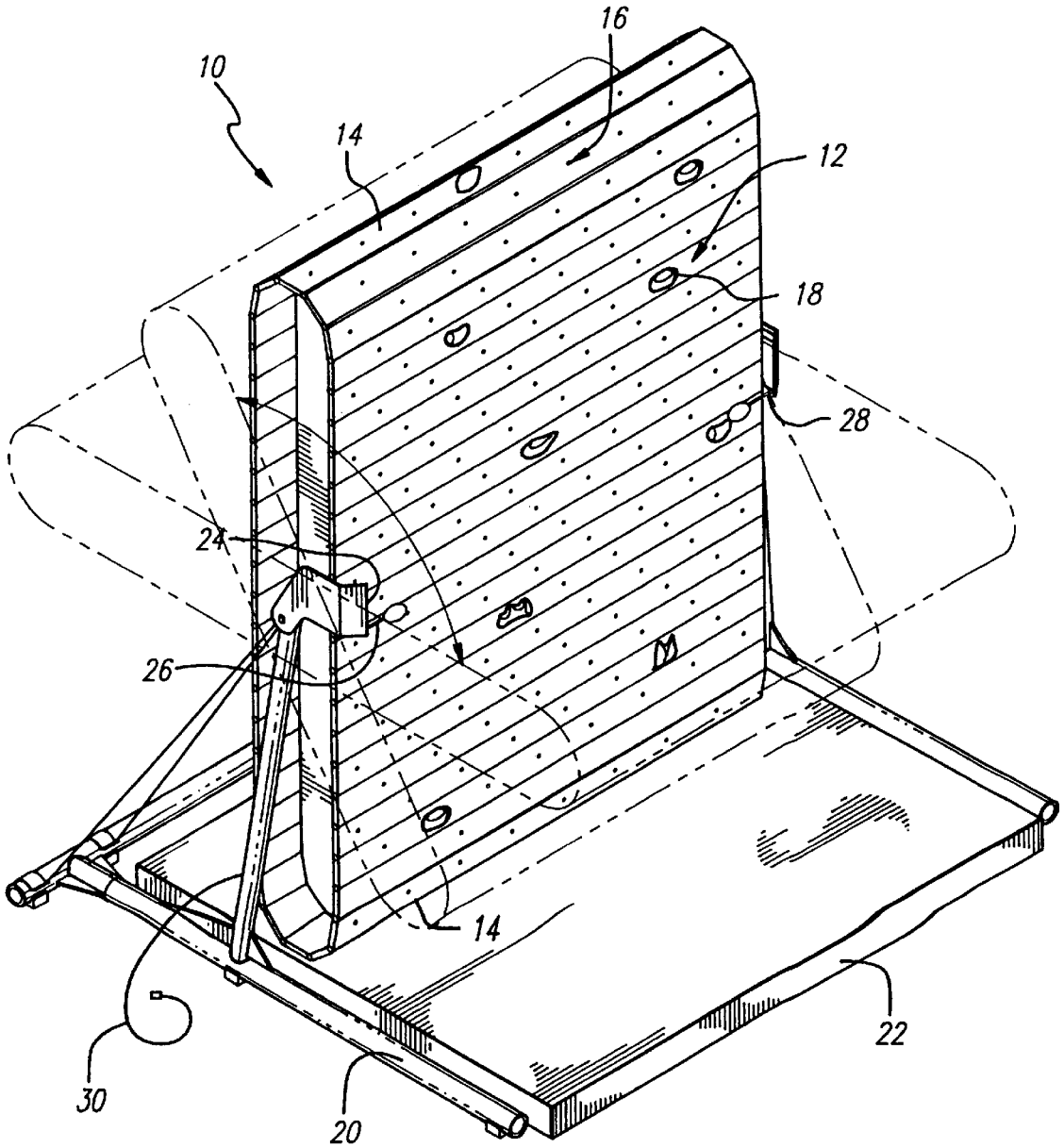
FIG. 1 is a perspective view of a climbing wall apparatus of the invention.

With reference to FIG. 1 of the drawings, which are given by way of example and not by way of limitation, a climbing wall apparatus 10 of the invention includes a continuous climbing surface 12 comprising rotatably interconnected extruded aluminum panels 14 having receptacles 16 for releasably receiving climbing hold fixtures 18 of various configurations. The nature and placement of the hold fixtures can be varied between climbs to provide more variation of the climbing surface in training. The climbing surface is carried by an inner frame (not shown) pivotably supported by an outer frame 20. A cushioned mat 22 is provided to cushion the impact of a climber's body as a result of a fall. A control panel 24 is provided adjacent the wall surface for convenient access, including access by a climber on the wall surface 12. Additionally two emergency stop pads 26, 28 are provided which when moved stop the rotation of the wall surface. Power is provided via a power cord 30 of conventional configuration. A cover 29 is provided on each side of the inner frame (not shown).

The control panel 24 allows a user climbing on the trainer to reach over and adjust the inclination of the wall surface and the speed of the wall surface. The control panel also includes an indication of the "height" climbed which is a resetable measurement of the distance the wall surface has moved. The control panel is electrically connected to a conventional controller (not shown) which controls the speed and direction of drive motors which actuate the climbing wall apparatus of the climbing trainer. The inclination of the climbing surface is rotatably adjustable over a range inclinations from a positive 15 degrees to one of negative 90 degrees (horizontal) as shown.

Figure 2:
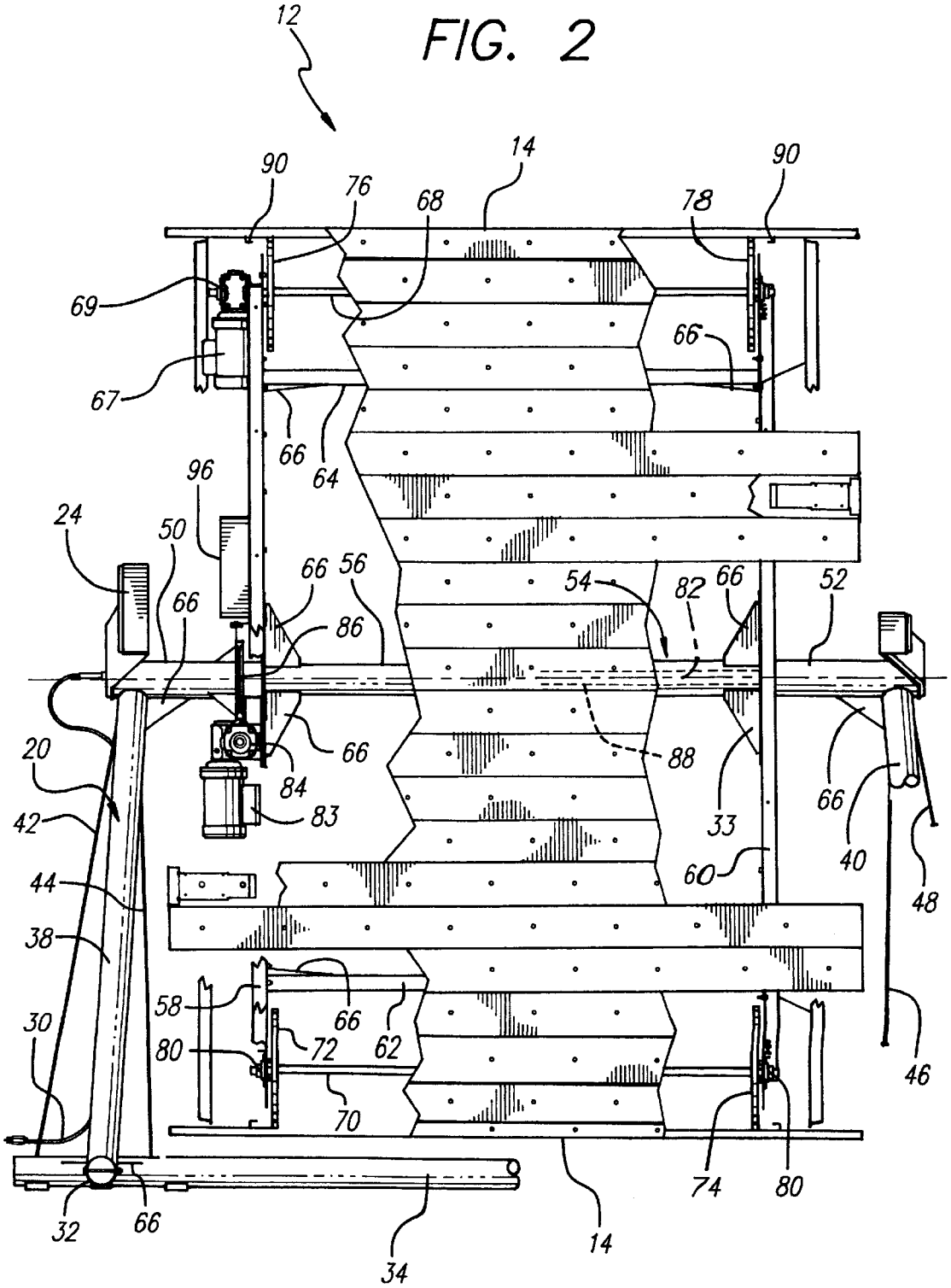
FIG. 2 is an elevational view, partly in section, of the apparatus of FIG. 1.
Figure 3:
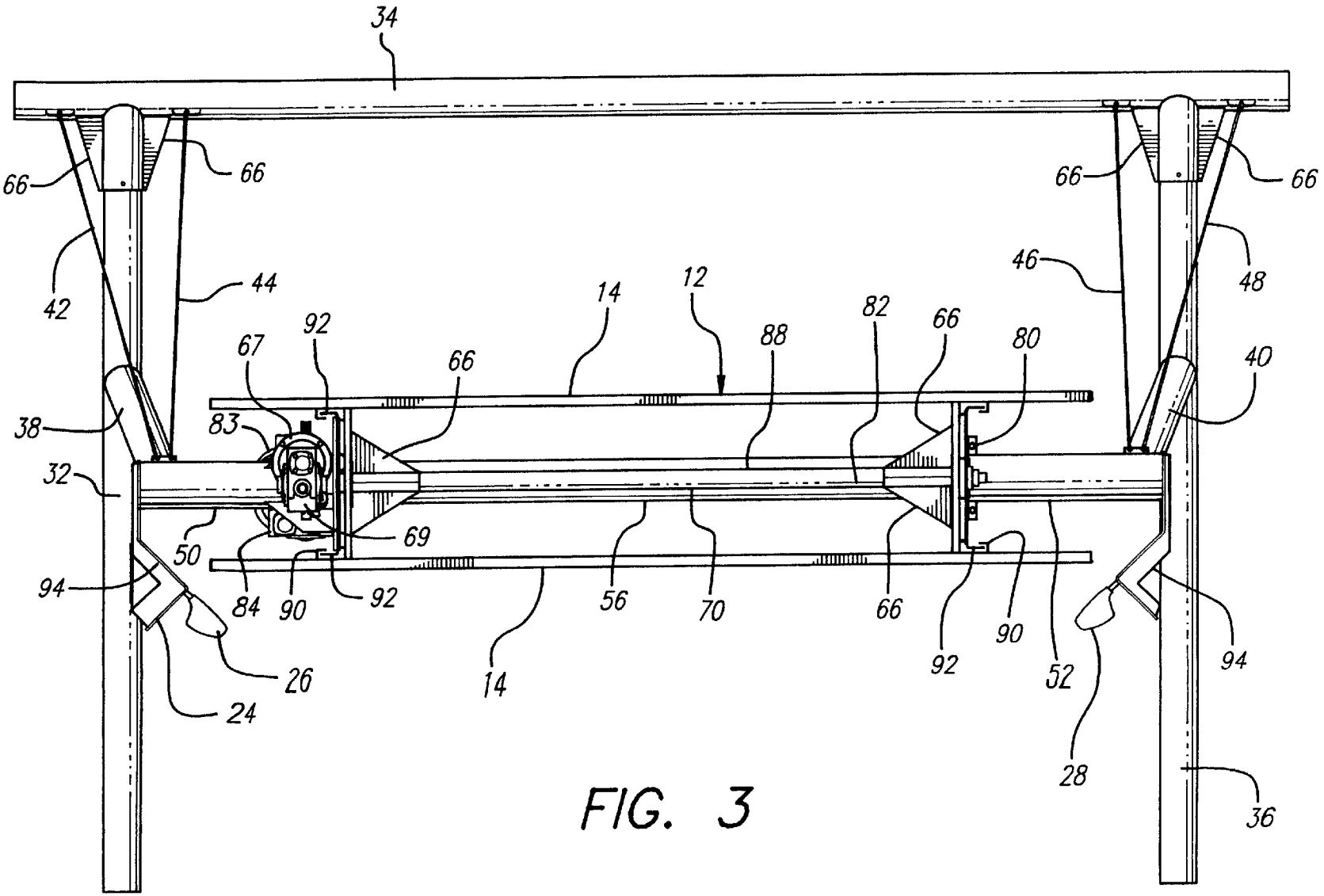
FIG. 3 is a view from above, partially in section, of the climbing apparatus of FIG. 1.
Figure 4:
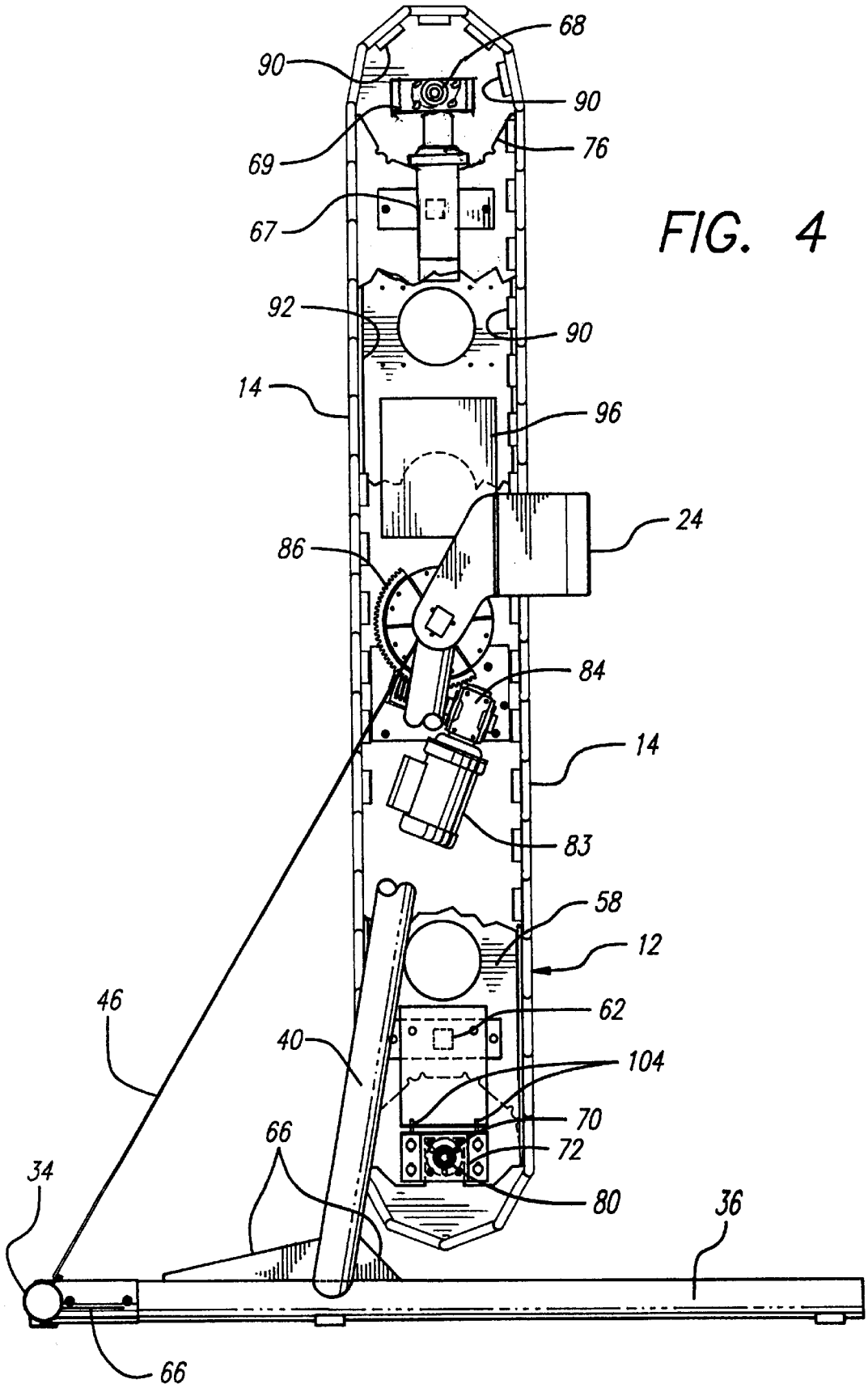
FIG. 4 is a side elevational view, partially in section, of the climbing trainer of FIG. 1.
Figure 5:
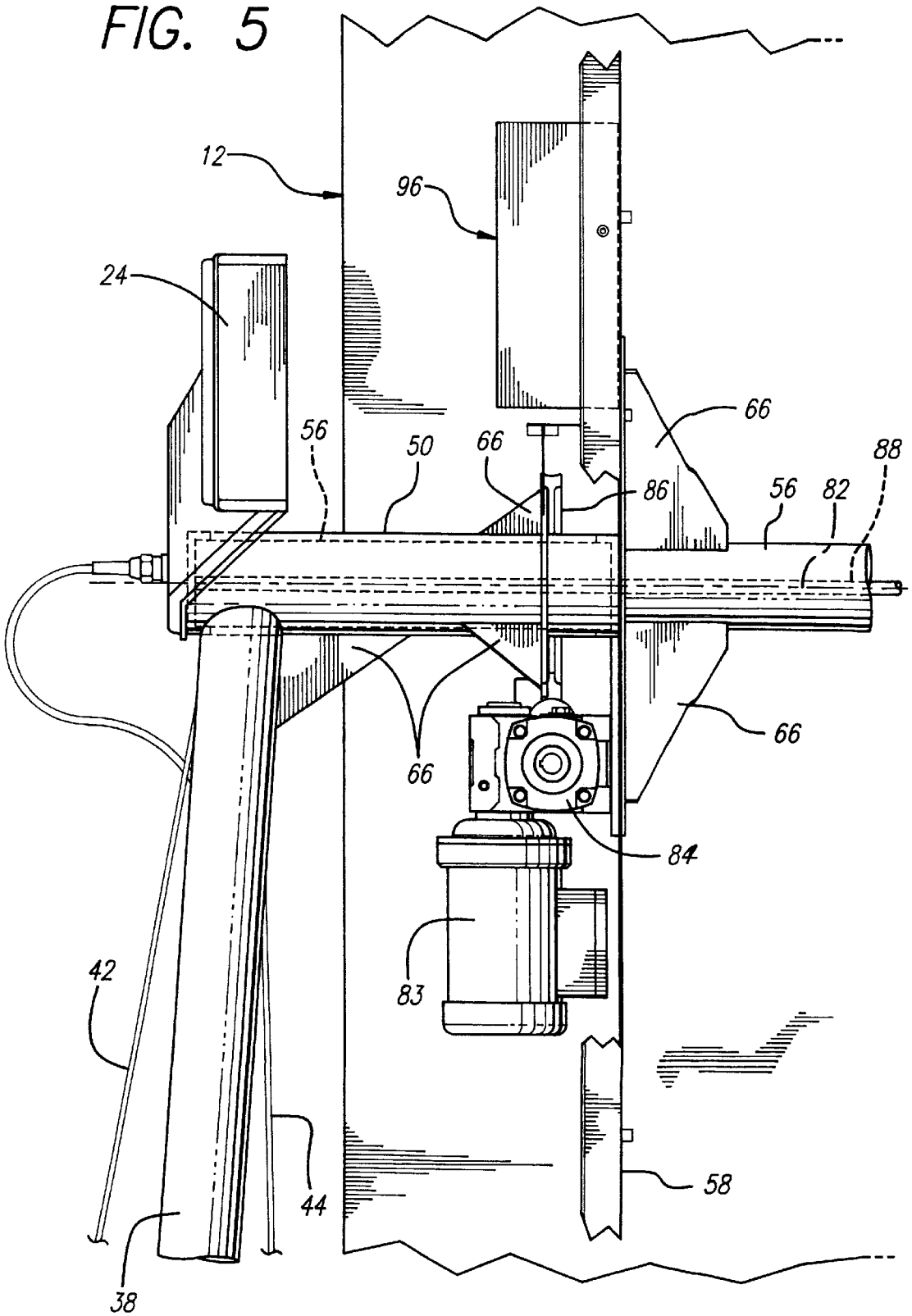
FIG. 5 is a more detailed front elevational view of a portion of the climbing trainer shown in FIG. 2.
Figure 6:
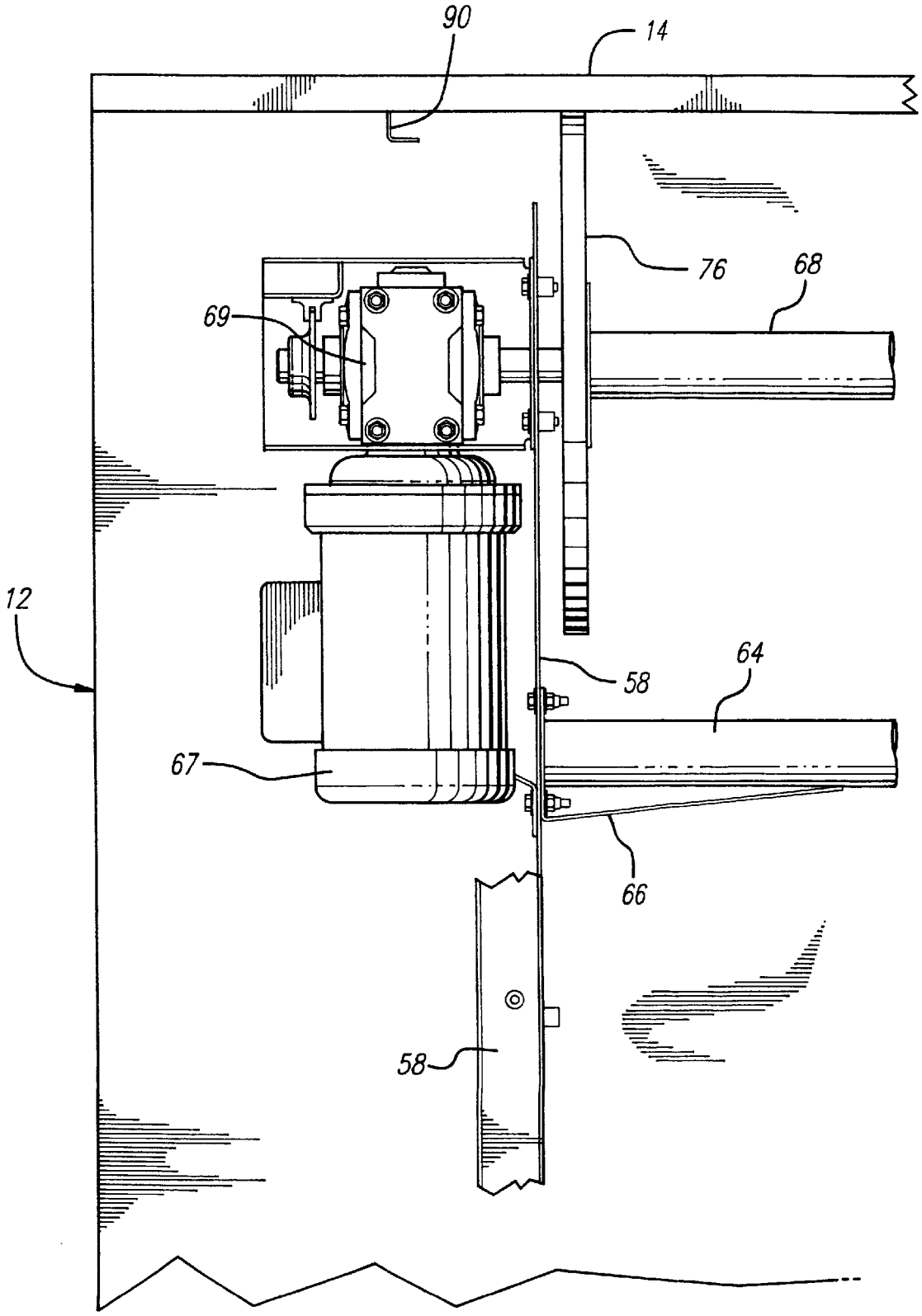
FIG. 6 is a more detailed front elevational view of a portion of the climbing trainer shown in FIG. 2.
Figure 7:
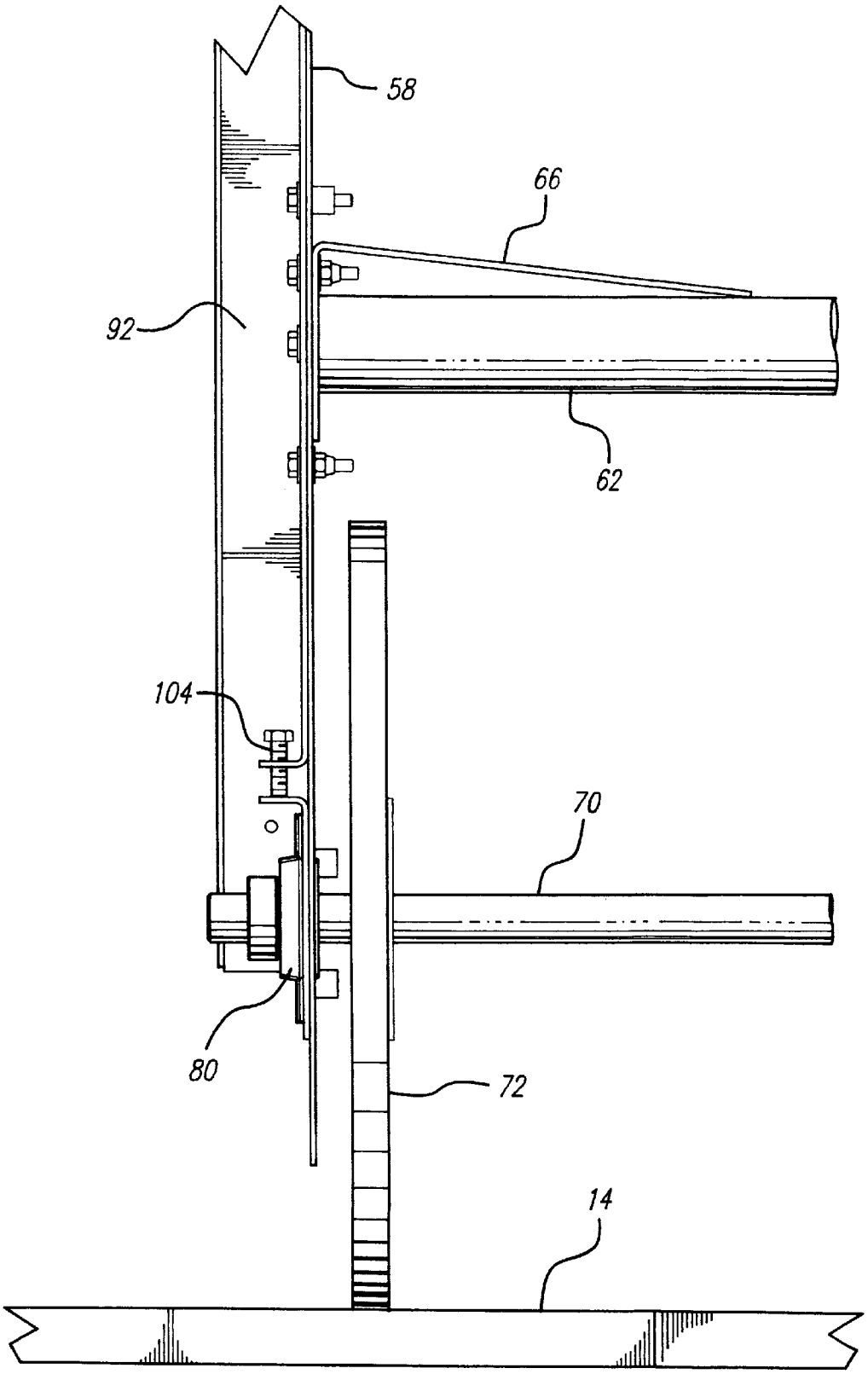
FIG. 7 is a more detailed front elevational view of a portion of the climbing trainer shown in FIG. 2.
Figure 8:
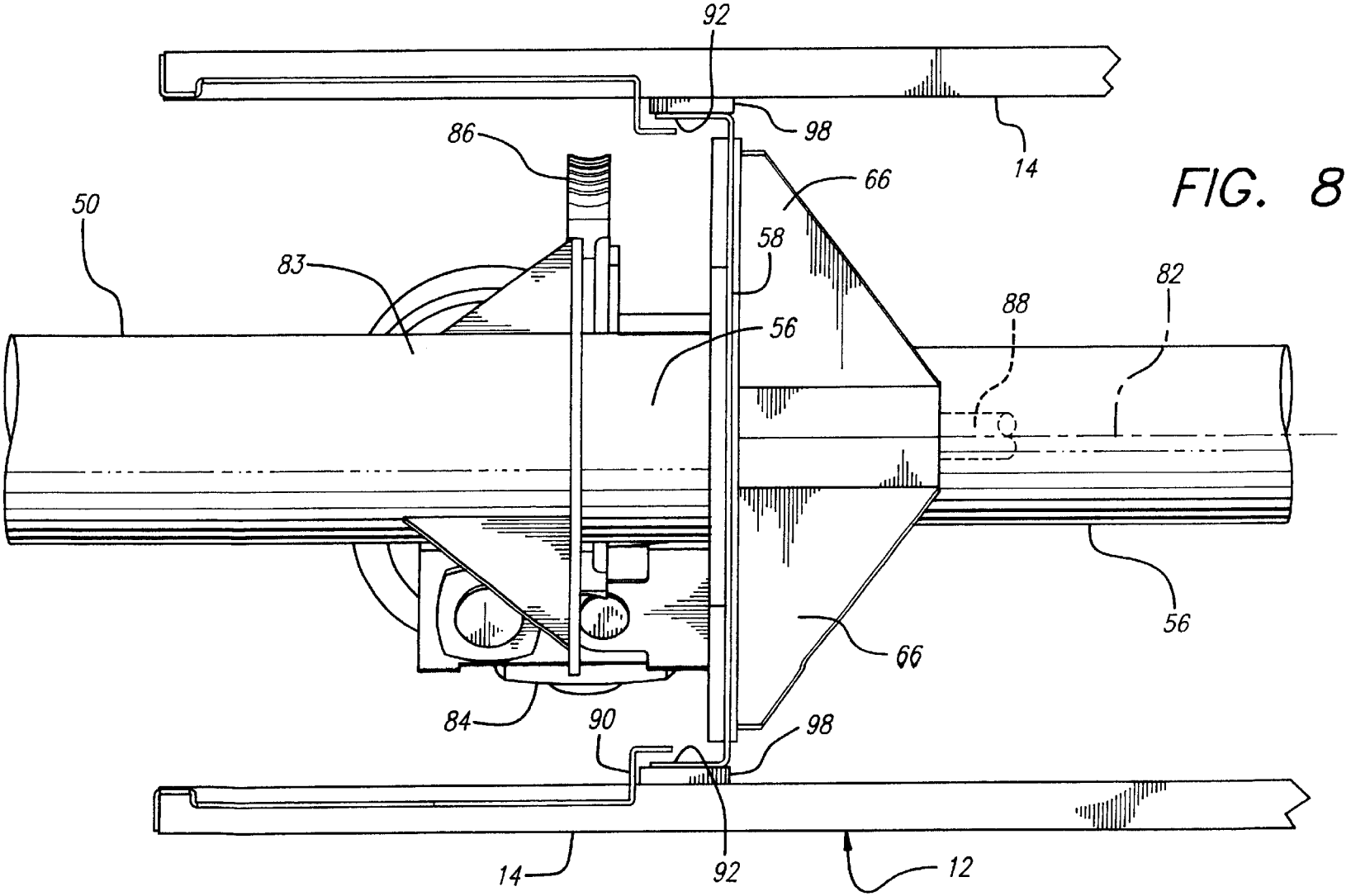
FIG. 8 is a more detailed top view of a portion of the climbing trainer shown in FIG. 3.

With reference to FIGS. 2, 3, and 4. the outer frame includes tubular steel members 32,34,36 comprising a base, 38 and 40 comprising risers, and adjustable tension members 42, 44,46, 48. The risers support stationary horizontal steel tubular members 50,52, which in turn rotatabley support the inner frame 54. The inner frame comprises a central rotating tubular member 56 formed of steel, side members 58, 60 and cross members 62 and 64. Braces 66 are used at points where frame members meet to provide increased rigidity. Horizontal axles 68, 70 are rotatabley supported by the side members adjacent the outer ends thereof. Axal 68 is driven by a drive motor and gear assembly 69, while axal 70 is freely rotatable. Octagonal spindles 72, 74, 76, 78 disposed on the axles engage rotatably linked aluminum extruded panels 14 comprising a rotatable climbing surface 12. The linked panels form a continuous belt-like structure which rotates about the spindles. The distance between axles 70 and 68 is adjustable by means of adjustability in the location of bearings 80 supporting axal 70. The entire inner frame 54 and the continuous rotatable wall surface 12 formed of the linked panels 14 is rotatable about a horizontal central axis 82 by means of a worm gear drive motor 83 and worm gear assembly 84 mounted on the side member 58 of the inner frame. Affixed circular gear 86 fixedly carried by the horizontal tubular sleeve 50 cooperates with the worm gear drive assembly to provide adjustability in the rotational position of the inner frame with respect to the horizontal central axis 82 and the outer frame 20. A central tension member 88 coaxial with the central axis 82 extends through the interior of horizontal tubular member 56 to increase rigidity of the outer frame and cooperates with the inner frame to provide this effect.

The panels 14 are guided and supported by the inner frame 54 by guide members 90 attached to the panels 14 which slidably engage and travel along the inner frame side members 58, 60 by cooperation with an outwardly extending flange 92 incorporated in the inner frame side members. Low friction materials such as lubricous polymer resin, teflon, or the like can be attached to the inner frame at points where the guide members slidably engage and contact it. This configuration prevents the panels forming the continuous wall from separating from the inner frame. This is very important when negative inclination is selected for the wall surface 12. A climber user's weight is supported in extreme negative inclination (horizontal) entirely by the guide members 90 slidably carried by the frame members 58, 60 at that position of the inner frame.

A control panel 24 is supported by the outer frame as before mentioned, as are emergency stop pads 26, 28 and the switches 94 actuated thereby which cut all power to all drive motors 69, 83. Further control electronics 96 are mounted on inner frame member 58. Rotation of the inner frame with respect to the inner frame being limited, flexible cables (not shown) can be employed in electrical connections between the control panel 24, power cord 30, emergency stop pad switches 94 and the further control electronics and drive motors mounted on the inner frame.

Further details can be appreciated with reference to FIGS. 5,6,7, and 8. Particularly with reference to FIG. 8, blocks of lubricous material 98 are attached to the flange 92 of the inner frame side member 58.

Figure 9:
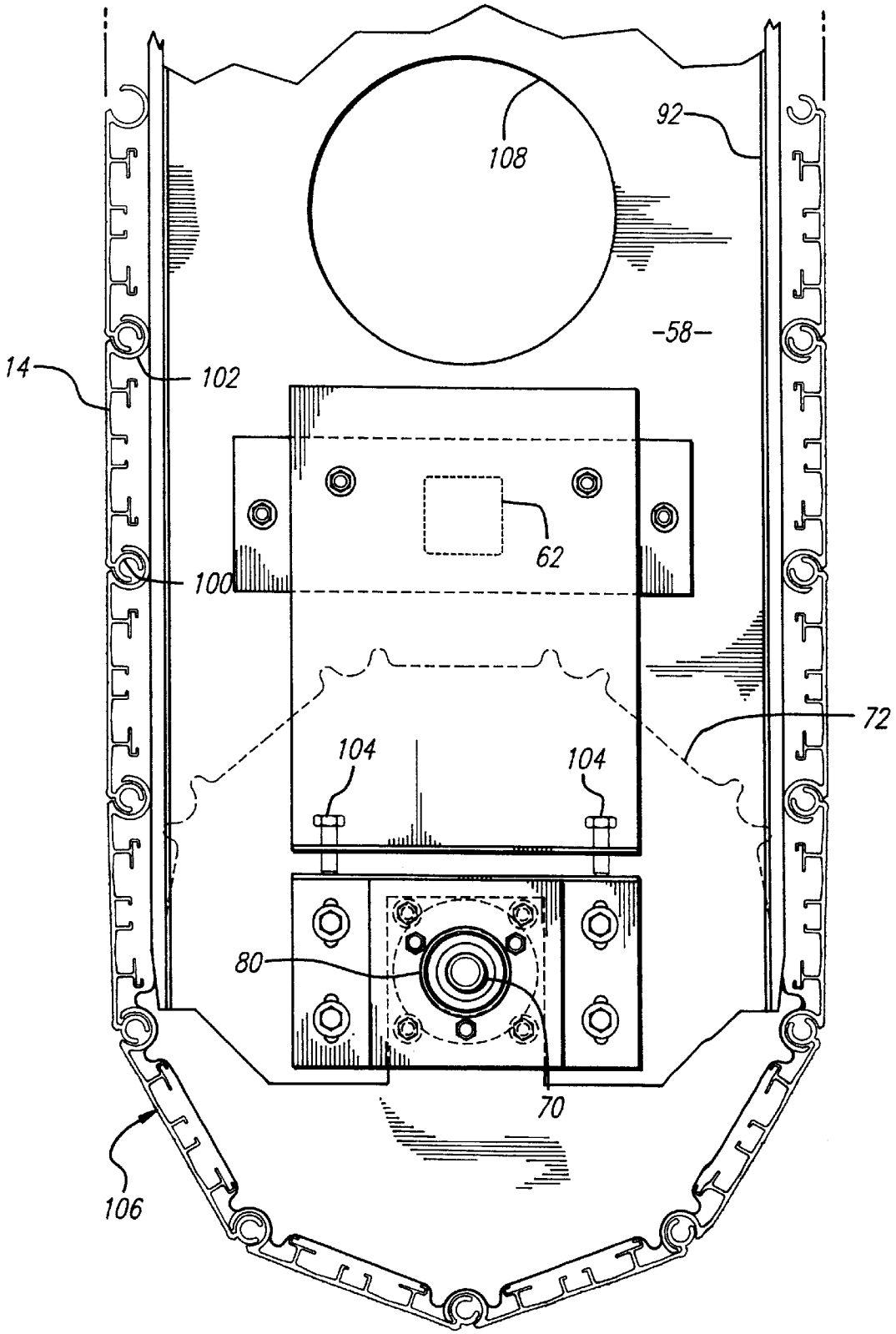
FIG. 9 is a more detailed side elevational view of a portion of the climbing trainer shown in FIG. 4.

Turning now to FIG. 9, details of the extruded aluminum panels 14 can be appreciated. Each panel comprises an inner hinge portion 100 and an outer hinge portion 102. Furthermore, the configuration of the panels are identical and cooperate with the octagonal spindle to provide smooth rotation. Adjustment bolts 104 allow adjustment of the tension of the continuous belt-like rotating wall 106 formed by the rotatably linked panels 14. Openings 108 ar provided to save weight in the side members (58 is shown).

Persons skilled in the art will readily appreciate that various modifications can be made from the presently preferred embodiments of the invention disclosed herein and that the scope of protection is intended to be defined only by the limitations of the appended claims.

We claim:

1. A climbing trainer having a movable training wall surface adapted to facilitate climbing training by a user, comprising:

a support frame;

a pivoting frame having first and second ends and a pivot axis intermediate the first and second ends, the pivoting frame being pivotably supported by the support frame allowing relative rotational movement about the pivot axis between the pivoting frame and the support frame said pivoting frame having a range of rotational movement between a vertical orientation and a horizontal orientation, said range of motion defining a range of movable climbing wall surface inclinations including at least a range from vertical to downwardly facing horizontal;

means for selectively allowing and preventing relative rotational movement between the support frame and the pivoting frame about the pivot axis;

a movable climbing training wall surface comprising a continuous belt having an outer surface adapted to incorporate climbing holds, said continuous belt being carried by and rotatable about said pivoting frame, the continuous belt being restrained from movement transverse to a plane of the climbing training wall surface so as to resist forces tending to pull climbing holds incorporated in the outer surface of the continuous belt away from the wall surface and those tending to push said holds towards the wall surface, the climbing training wall surface being moveable in a direction parallel to a plane defined by the training wall surface by rotation of the continuous belt about said pivoting frame; and an actuator adapted to rotate said continuous belt about the pivoting frame, whereby the climbing training wall surface is moved to provide a simulated climb, the inclination of the climbing training wall surface being adjustable by rotation of the pivotable frame over a range of inclinations including negative inclinations.

2. The climbing trainer of clam 1, further comprising first and second spindles rotatably carried by the pivot frame at the first and second ends respectively of said pivot frame and rotatable about two parallel axes, the continuous belt comprising said climbing training surface being disposed about said spindles and bending about said two parallel axes, and wherein the continuous belt is stiffened to resist bending about a further axis orthogonal to said two parallel axes about which the first and second spindles rotate.

3. The climbing trainer of claim 2, wherein the continuous belt further comprises a multiplicity of rotatably interlinked panels, each being rotatable with respect to another about an axis parallel to said two parallel axes about which said first and second spindles rotate, and configured to mitigate unintentional engagement of the training wall surface with said user and with clothing worn by said user which would otherwise be caught and moved with said wall surface by minimizing opening and closing of voids between said rotationally interlinked panels, said panels each further comprising an inner hinge portion disposed along a first side and an outer hinge portion disposed along said second side, said inner hinge portion having a cylindrical surface which presents forwardly and covers a space between panels that would otherwise open as the panels bend relative to one another from a first coplaner relative angular position to a second oblique relative angular position.

4. The climbing trainer of claim 3, further comprising a interchangeable hold releasably affixed to one of said rotationally interlinked panels.

5. The climbing trainer of claim 4, wherein said actuator comprises a variable speed motor coupled to at least one of said first and second spindles, said climbing trainer further comprising a speed control operable from said continuous climbing surface, said speed control being adapted to vary the speed of the motor.

6. The climbing trainer of claim 5, further comprising a safety kill switch operable from said continuous climbing training surface and adapted to stop movement of said climbing trainer.

7. The climbing trainer of claim 3, wherein the rotatably interlinked panels comprise unitary extrusions having first and second sides comprising inner hinge portion having an outer cylindrical configuration at the first side and an outer hinge portion at the second side having an inner cylindrical configuration configured to engage said inner hinge portion of an adjacent panel and cooperate to provide a hinge between adjacent panels.

8. The climbing trainer of claim 7, wherein said rotatably interlinked panels are formed of a metal comprising aluminum.

9. A climbing trainer having a movable training wall surface adapted to facilitate climbing training by a user, comprising:

a support frame further comprising a base and a riser;

a pivoting frame having first and second ends and a pivot axis intermediate the first and second ends, the pivoting frame being pivotably supported by said riser, allowing relative rotational movement about the pivot axis between the pivoting frame and the support frame said pivoting frame having a range of motion including a vertical orientation and a horizontal orientation;

a worm wheel carried by one of two elements consisting of said support frame and said pivoting frame;

a worm carried by the other one of said two elements consisting of said support frame and said pivoting frame said pivoting frame;

a worm drive actuator coupled to said worm, said worm acting to prevent relative rotational movement between the support frame and the pivoting frame about the pivot axis when said worm is not turning due to force generated by said actuator, and said worm acting to cause relative rotational movement between the support frame and the pivoting frame about the pivot axis when the worm is turned by said actuator;

a movable climbing training wall surface comprising a continuous belt having an outer surface adapted to incorporate climbing holds, said continuous belt being carried by and rotatable about said pivoting frame, the continuous belt being restrained from movement transverse to a plane of the climbing training wall surface so as to resist forces tending to pull climbing holds incorporated in the outer surface of the continuous belt away from the wall surface and those tending to push said holds towards the wall surface, the climbing training wall surface being moveable in a direction parallel to a plane defined by the training wall surface by rotation of the continuous belt about said pivoting frame;

first and second spindles rotatably carried by the pivot frame at the first and second ends respectively of said pivot frame and rotatable about two parallel axes, the continuous belt comprising said climbing training surface being disposed about said spindles and bending about said two parallel axes, and wherein the continuous belt is stiffened to resist bending about a further axis orthogonal to said two parallel axes about which the first and second spindles rotate; and a variable speed belt actuator adapted to rotate said continuous belt about the pivoting frame, whereby the climbing training wall surface is moved to provide a simulated climb, the inclination of the climbing training wall surface being adjustable by rotation of the pivotable frame over a range of inclinations including negative inclinations.

10. The climbing trainer of claim 9, further comprising in combination a control panel accessible from said climbing wall surface allowing selective actuation of the belt actuator and variation of the speed of the actuator to control the speed of rotation of the continuous belt.

11. The climbing trainer of claim 9, further comprising in combination a control panel accessible from said climbing wall surface allowing selective actuation of the worm actuator to control the relative position of the pivotable frame and the support and thereby control the inclination of the climbing training surface.

12. The climbing trainer of claim 9, wherein the continuous belt further comprises a multiplicity of rotatably interlinked panels, each having a front face and being rotatable with respect to another about an axis parallel to said two parallel axes about which said first and second spindles rotate, and configured to mitigate unintentional engagement of the training wall surface with things which would otherwise be caught and moved with said wall surface by minimizing opening and closing of voids between said rotationally interlinked panels, said panels including a first panel and a second panel joined by a hinge further comprising an inner hinge portion comprising a cylindrical surface adjacent and joining the front face of said first panel substantially tangentially and which is disposed behind the front face of said second panel when said panels are disposed substantially coplanar so as to present as a wall on a front side of said pivoting frame and is exposed by relative rotation of said first and second panels about said hinge as said panels travel around the first and second ends of said pivoting frame so as to maintain a substantially continuous surface between the front faces of said first and second panels.

13. The climbing trainer of claim 12, wherein the rotatably interlinked panels are extrusions formed of a metal comprising aluminum having first and second sides comprising said inner hinge portion disposed at the first side and an outer hinge portion at the second side having an inner cylindrical configuration configured to engage an inner hinge portion disposed at the first side of an adjacent panel and cooperate to provide a hinge between adjacent panels.

14. The climbing trainer of claim 13, wherein said continuous belt defines an inner surface and first and second ends, said belt being slidably connected to said pivoting frame by at least one connection between said pivoting frame and said inner surface intermediate the first and second ends of the belt, and wherein said connection allows relative movement of the frame and continuous belt in a direction parallel to a plane defined by the climbing training wall surface and restricts movement in a direction orthogonal to said plane, whereby said continuous belt is restricted from movement orthogonal to said plane defined by the climbing wall surface by at least one sliding connection to the pivoting frame intermediate the first and second edges of the belt.

15. The climbing trainer of claim 9, wherein said range of inclinations comprises those negative inclinations between a maximum negative inclination where said climbing training wall surface is disposed horizontally facing downward and a minimum negative inclination where said climbing training wall surface is disposed vertically.

16. A climbing trainer having a movable training wall surface adapted to facilitate climbing training by a user, comprising:

a support frame further comprising a base and a riser;

a pivoting frame having first and second ends and a pivot axis intermediate the first and second ends, the pivoting frame being pivotably supported by a riser of the support frame and allowing relative rotational movement about the pivot axis between the pivoting frame and the support frame;

a worm gear further comprising a concave-faced worm wheel fixed to said support frame and a worm rotatably attached to said pivoting frame selectively rotated by a first rotational actuator including an electric motor controllable to relatively rotationally position the pivot frame and the support and by activation and deactivation of said actuator selectively allowing and preventing relative rotational movement between the support frame and the pivoting frame about the pivot axis;

a movable climbing training wall surface comprising a continuous belt having an outer surface adapted to incorporate interchangeable climbing holds, said continuous belt being carried by and rotatable about said pivoting frame, the continuous belt being restrained from movement transverse to a plane of the climbing training wall surface so as to resist forces tending to pull climbing holds incorporated in the outer surface of the continuous belt away from the wall surface and those tending to push said holds towards the wall surface, the climbing training wall surface being moveable in a direction parallel to a plane defined by the training wall surface by rotation of the continuous belt about said pivoting frame, said belt further comprising a multiplicity of rotatably interlinked panels having front faces, said panels further comprising stiffeners so as to resist bending, the panels being configured to join by a hinged joint further comprising an inner hinge portion and an outer hinge portion, said inner hinge portion having a cylindrical surface substantially tangentially meeting the front face of adjoining panels to fill a space otherwise opening between adjacent panels as said panels articulate as said continuous belt bends around said pivoting frame, whereby said inner and outer hinge portions cooperate to minimize opening and closing of voids open to said outer surface of said bed as said belt turns, whereby a tendency to pinch is mitigated;

first and second spindles rotatably carried by the pivot frame at the first and second ends respectively of said pivot frame and rotatable about two parallel axes, the continuous belt comprising said climbing training surface being disposed about said spindles and bending about said two parallel axes, and wherein the continuous belt is stiffened to resist bending about a further axis orthogonal to said two parallel axes about which the first and second spindles rotate; and a second rotational actuator comprising a variable speed belt actuator coupled to at least one of said spindles and adapted to rotate said continuous belt about the pivoting frame, whereby the climbing training wall surface is moved to provide a simulated climb; the inclination of the climbing training wall surface being adjustable by rotation of the pivotable frame over a range of inclinations including negative inclinations;

a control panel accessible from said climbing training surface adapted to allow control of said first actuator and said second actuator to enable selection of a desired inclination of said climbing wall surface and a speed of movement of said climbing wall surface, whereby the inclination and speed of movement of said movable training wall surface can be changed automatically solely by the user by means of the control panel without additional effort and without intervention by others.

17. A climbing trainer having a movable training wall surface adapted to facilitate climbing training by a user, comprising:

a frame having a first end and a second end;

a movable climbing training wall surface comprising a continuous belt formed by a multiplicity of interlinking panels rotatably disposed about said frame, said panels each having a first end and a second end, said first and second ends collectively forming a first end and second end of said continuous belt, and each of said panels having an outwardly facing climbing training wall surface face and an opposite rear face and two sides disposed perpendicularly to a direction of movement of said climbing wall surface, said continuous belt further comprising a first interlinking panel and a second interlinking panel, said second interlinking panel being adjacent said first interlinking panel, and a hinge between said adjacent first and second interlinking panels, said hinge allowing relative rotational movement between said first and second interlinking panels and rotatably linking adjacent sides of said first and second panels, said hinge further comprising an inner hinge portion connected to said first interlinking panel, said inner hinge portion having a cylindrical outer surface appearing in transverse section as a circular arc portion, and an outer hinge portion having a complementary cylindrically shaped inner surface appearing in transverse section as a circular arc portion configured to cooperate with said outer surface of said inner hinge portion to provide for relative rotation of the inner and outer hinge portions, said inner hinge portion being rotatably received in said outer hinge portion, said outer hinge portion being connected to said second panel, said outer hinge portion enveloping said inner hinge portion to an extent that said inner hinge portion interlinks with said outer hinge portion preventing separation of said inner and outer hinge portions, a portion of said outer cylindrical surface of said inner hinge portion presenting outwardly between said outwardly facing climbing training wall surfaces of said first and second panels so as to mitigate opening and closing of spaces between said adjacent first and second panels as the continuous belt rotates around said frame.

18. The climbing trainer of claim 17, wherein said hinge is continuous along said adjacent sides of said first and second panels.

19. The climbing trainer of claim 18, wherein said inner hinge portion is slidingly received in said outer hinge portion, whereby panels can be successively interlinked by sliding them together to form a secession of interlinking panels in forming said continuous belt.

20. The climbing trainer of claim 19, wherein said interlinking panels further comprise stiffening ribs disposed on said rear face.

* * * * *